US005619839A

United States Patent [19]

Peppard et al.

[11] Patent Number: 5,619,839

[45] Date of Patent: Apr. 15, 1997

[54] PACKAGING MACHINE AND METHOD

[75] Inventors: James P. Peppard, Newbury; Anthony H. Gates, Atwater, both of Ohio

[73] Assignee: Automated Packaging Systems, Inc., Streetsboro, Ohio

[21] Appl. No.: 398,697

[22] Filed: Mar. 6, 1995

Related U.S. Application Data

[62] Division of Ser. No. 95,947, Jul. 22, 1993, Pat. No. 5,394,674, which is a division of Ser. No. 877,472, May 1, 1992, Pat. No. 5,259,172, which is a continuation-in-part of Ser. No. 795,669, Nov. 21, 1991, Pat. No. 5,265,402, which is a division of Ser. No. 471,850, Jan. 29, 1990, Pat. No. 5,070,674, which is a continuation-in-part of Ser. No. 395,957, Aug. 18, 1989, Pat. No. 5,077,958.

[51] Int. Cl.[6] ..... B65B 39/02; B65B 39/06

[52] U.S. Cl. ..... 53/260; 53/261

[58] Field of Search ..... 53/384.1, 385.1, 53/386.1, 260, 261, 570, 572, 573

[56] References Cited

U.S. PATENT DOCUMENTS

| | | | |
|---|---|---|---|
| 2,234,951 | 3/1941 | Belcher | 53/385.1 X |
| 2,973,612 | 3/1961 | McGowan | 53/384.1 |
| 3,011,297 | 12/1961 | McDevitt | 53/261 |
| 3,138,907 | 6/1964 | Gerbe | 53/385.1 |
| 3,673,759 | 7/1972 | Ayres et al. | 53/386.1 X |
| 3,830,038 | 8/1974 | Propst | 53/386.1 X |
| 4,182,094 | 1/1980 | Lieder et al. | 53/386.1 X |
| 4,432,186 | 2/1984 | McGregor | 53/386.1 X |
| 5,323,591 | 6/1994 | Inman et al. | 53/384.1 X |

*Primary Examiner*—Horace M. Culver

*Attorney, Agent, or Firm*—Watts, Hoffmann, Fisher & Heinke Co., L.P.A.

[57] ABSTRACT

A packaging machine and method of packaging utilizing chains of interconnected preopened bags which are fed sequentially and one at a time to a load station. Bag tops are clamped against spreading horns by sensor equipped clamps which cause disablement of a bag filling mechanism unless a bag is properly located at the load station. The horns include mirror image subassemblies each including stationary and moveable sections. Each subassembly includes a prime mover interposed between the sections to relatively move the sections between collapsed and bag extending positions.

9 Claims, 6 Drawing Sheets

PACKAGING MACHINE AND METHOD

This is a divisional of application Ser. No. 08/095,947, filed on Jul. 22, 1993, now U.S. Pat. No. 5,394,674, issued on Mar. 07, 1995; which is a divisional of Ser. No. 07/877,472, filed on May 1, 1992, now U.S. Pat. No. 5,259,172, issued on Nov. 09, 1993; which is a continuation-in-part of Ser. No. 07/795,669, filed on Nov. 21, 1991, now U.S. Pat. No. 5,265,402, issued on Nov. 30, 1993; which in turn is a divisional of Ser. No. 07/471,850, filed on Jan. 29, 1990, now U.S. Pat. No. 5,070,674, issued Dec. 10, 1991; which in turn is a continuation-in-part of application Ser. No. 07/395,957, filed on Aug. 18, 1989, now U.S. Pat. No. 5,077,958, issued on Jan. 7, 1992; each of which was or is entitled PACKAGING MACHINE AND METHOD. The patents are referred to herein as The Issued Patents.

DISCLOSURE OF THE INVENTION

This invention relates to packaging and more particularly to a novel and improved method and apparatus of packaging bulky materials in bags.

BACKGROUND OF THE INVENTION

The packaging of candy, lettuce and other food products in bags presents some problems. First among these is that the equipment for doing so must be constructed in such a way that it is readily sanitizable and otherwise meets standards of cleanliness such as, in the United States, regulations of the Federal Government.

Bulky food products such as leaf lettuce present special problems. One of the problems is substantial quantities of air are in a lettuce-filled bag, Further, if the lettuce is wet, surfaces to be sealed become wetted, inhibiting proper scaling.

The use of chains of pre-opened bags to form packages is now well known. Such chains of bags are disclosed and claimed in U.S. Pat. No. 3,254,828 entitled FLEXIBLE CONTAINER STRIPS (The Autobag Patent). A commercial version of a machine described and claimed in U.S. Pat. No. 3,965,653 entitled PACKAGING APPARATUS, and in other patents deriving from the applications that resulted in this patent, (the H-100 Patents) has been sold commercially by Automated Packaging Systems, Inc. under the designation H-100. While the H-100 machine has been very successful it is a machine in which bag separation and sealing of a loaded bag are completed before a succeeding bag is positioned in an opened condition at a load station and loaded. This sequential operation is a limiting factor on the speed at which packaging operations are performed.

Another machine which has been successfully used commercially, for bagging chickens in operations where the bags are not sealed is sold by Automated Packaging as a part of its PHS-2000 system and is the commercial version of the machine described and claimed in U.S. Pat. RE 32,963 entitled PACKAGING APPARATUS AND METHOD (The Chicken Bagger Patent).

A limitation on the use of chains of interconnected pre-opened bags has been when heavy or bulky products are packaged it becomes difficult to properly register the face of the bag with the back of the bag to effect a high quality, neat appearing seal. While special techniques and equipment such as that described in U.S. Pat. No. 3,956,866 entitled PACKAGING METHOD AND APPARATUS have been developed to assist in the proper packaging of relatively bulky and/or heavy materials, the use of pre-opened bags on a roll has none the less been limited to moderate size bags. The essentially bulk packaging of such products as lettuce have at most been packaged with chains of pre-opened bags in very limited quantities if at all.

A number of proposals have been made for expelling air from loaded bags. U.S. Pat. No. 3,861,113 entitled PACKAGING APPARATUS AND METHOD (the Deflator Patent) and U.S. Pat. No. 3,477,196 entitled MECHANISM FOR AUTOMATICALLY FEEDING, LOADING AND SEALING BAGS (the Automatic Machine Patent) are examples. None have been fully satisfactory for compacting bags of leafy vegetables.

In the packaging of some materials it has been considered desirable to charge gas into the package or to evacuate the package or both. Currently, at least one state has regulations limiting the use .of bag evacuators and there are those who are concerned with charging gases into gas of food products.

SUMMARY OF THE INVENTION

In the currently preferred embodiment of a system utilizing the present invention, a machine of the type described and claimed in the Chicken Bagger Patent is provided. A dispenser is mounted above the bag machine for discharging premeasured quantities of material to be packaged sequentially and one quantity at a time. A suitable dispenser for this purpose is that sold commercially under the designation Model F-108 Automatic Scale by Tridyne Process Systems.

A bag shuttle mechanism is provided to transport bags from a load station to a sealing station and thence discharge loaded and sealed packages. With a system made in accordance with this invention bag spreaders in the configuration of the horns of the Chicken Bagger Patent are provided, but in a modified form. Each of the horns has a finger receiving recess formed in it. In addition, the horns used are a modified form of the collapsible horns disclosed in the parent case to provide a bag opening that is generally circular for receipt of bulky products.

A bag stretcher is provided. The bag stretcher includes spaced mirror image mechanisms which are spread to close a loaded bag. These are described more fully in parent applications including The Issued Patents, both of which are incorporated by reference in their entireties. The spreading of the mechanisms not only juxtaposes the top portions, but also expels entrapped air from the bag. Once the portions are juxtaposed, the contents are compressed and further entrapped air is expelled.

The bag stretcher is mounted on a carriage. The carriage in turn is mounted on guides which permit the carriage and supported stretcher to reciprocate from a position where a loaded bag is grasped and spread to a position where a loaded bag has been moved into a bag closure station. Concurrent with the movement of the loaded bag from the loading station to the closure station a subsequent bag is fed into the loading station and loading of the subsequent bag commences.

In the parent case, intermediate bag supports were provided. With the improved machine of this disclosure which is utilizable for bagging such leafy products as leaf lettuce, the side supports are each in the form of a multiple sectioned elongate channel, each of which extends vertically essentially the entire height of the bag. Each of these bag supports includes an L-shaped section forming the front and side and a relatively movable back plate section. The sections together form a channel having a horizontal cross section in the shape of a squared U. The supports are connected respectively to air cylinders which shift the supports between substantially abutting relationship defining a bag filling cavity of rectangular cross section and a spaced bag release position.

In the improved machine, an improved bag base support is provided at the load station. This bag support also functions to provide lower support for a loaded bag as it is transported from the load of the seal station. The improved bag support has a generally flat top and a generally rectangular configuration sized to fit within the bag filling space defined by the side supports when they are in their bag space defining position. After the desired quantity of lettuce has been deposited into a bag at the load station, a solenoid controlled base support elevating mechanism is oscillated repeatedly and at relatively high speeds. This causes the base support to reciprocate vertically and shake the lettuce to settle it down into a compact configuration with a substantial reduction in the amount of entrapped air.

Alternatively, the cylinders connected to the back plate section can be oscillated to shake the lettuce and compact and settle it to remove air. Where the smaller so-called retail bags are being loaded, for example, with carrots, the bag support is not oscillated. Rather, compression of the bag to expel air and provide close packaging is accomplished by advancing the back panel sections forwardly.

Once a bag has been loaded with, in the present example, leaf lettuce, and the lettuce has been agitated to compress it, the carriage shifts to move the loaded bag to the closure station. The closure station has a horizontally disposed "squasher" plate below the heat sealer. As the carriage shifts the loaded bag from the load to the sealing station, the base support is elevated, and the bag of lettuce is forced under the squasher plate further compressing the bag contents and further expelling entrapped air.

A clamp and heat sealer corresponding to that disclosed in the parent application, except for the sealer itself, closes on the bag to effect a heat seal. The side supports are then spread apart so that the carriage can return for a subsequent loading cycle. Concurrently, a closure station bag support is elevated to support the bag once it is released by the clamp and sealer.

In a subsequent cycle, the closure station bag support is lowered as the carriage is advanced to deliver a subsequent and now loaded bag to the closure station. Concurrently, the loaded and sealed bag from the previous cycle is pushed from the closure station to expel it from the machine into a collection container or onto a conveyer.

One of the outstanding advantages of the improved machine is the provision of a sealer with three heater bars. The upper one of the heater bars is individually controlled at a relatively elevated temperature so that it effects both the seal and a cut-off of excess plastic at the top of the bag. The, lower two heater bars are concurrently controlled. Two are provided for redundancy so that a secure airtight seal is assured.

A novel and improved method of packaging food stuff such as leaf lettuce provides another facet of the invention. With the compaction method which has been described, a very tightly packed, yet not crushed, quantity of lettuce is within the bag and very little air remains with it. As contrasted with evacuating techniques previously employed, if the lettuce is wet, the water is retained in the bag and not removed with the air as is the case with bag evacuation techniques. The bags themselves are formed of Ethylene Vinyl Acetate. This material has the characteristic of allowing oxygen to pass through it while retaining nitrogen within the package. Thus, the method further includes the step of containing nitrogen from the air within the package while allowing oxygen to escape thereby providing fresh wet lettuce in an essentially inert atmosphere within the bag.

Accordingly, the objects of the invention are to provide a novel and improved bulk packaging mechanism, and a method of effecting packaging.

DESCRIPTION OF PREFERRED EMBODIMENT

Figure 1:
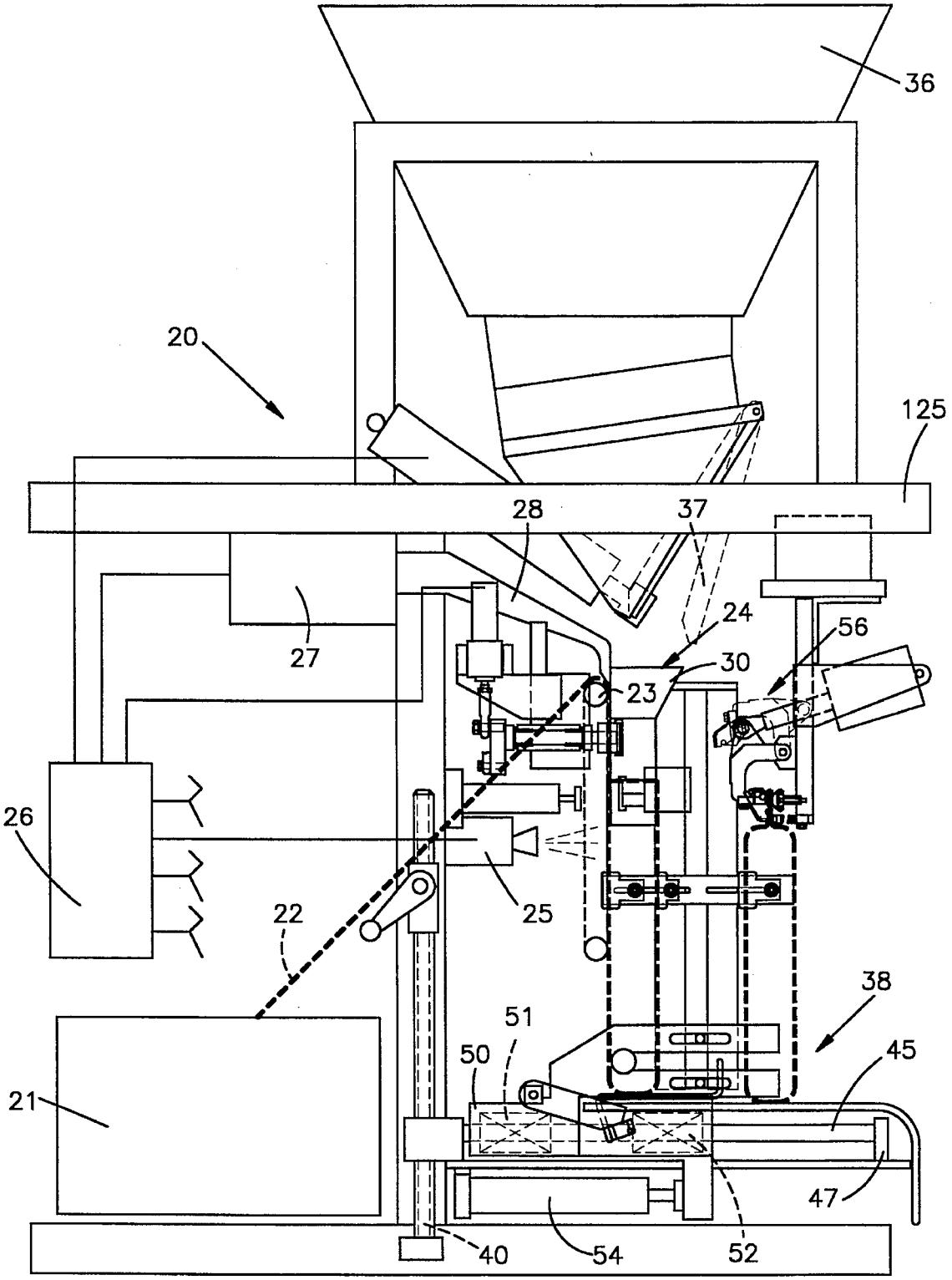
FIG. 1 is a side elevational view of the machine of The Issued Patents.
Figure 2:
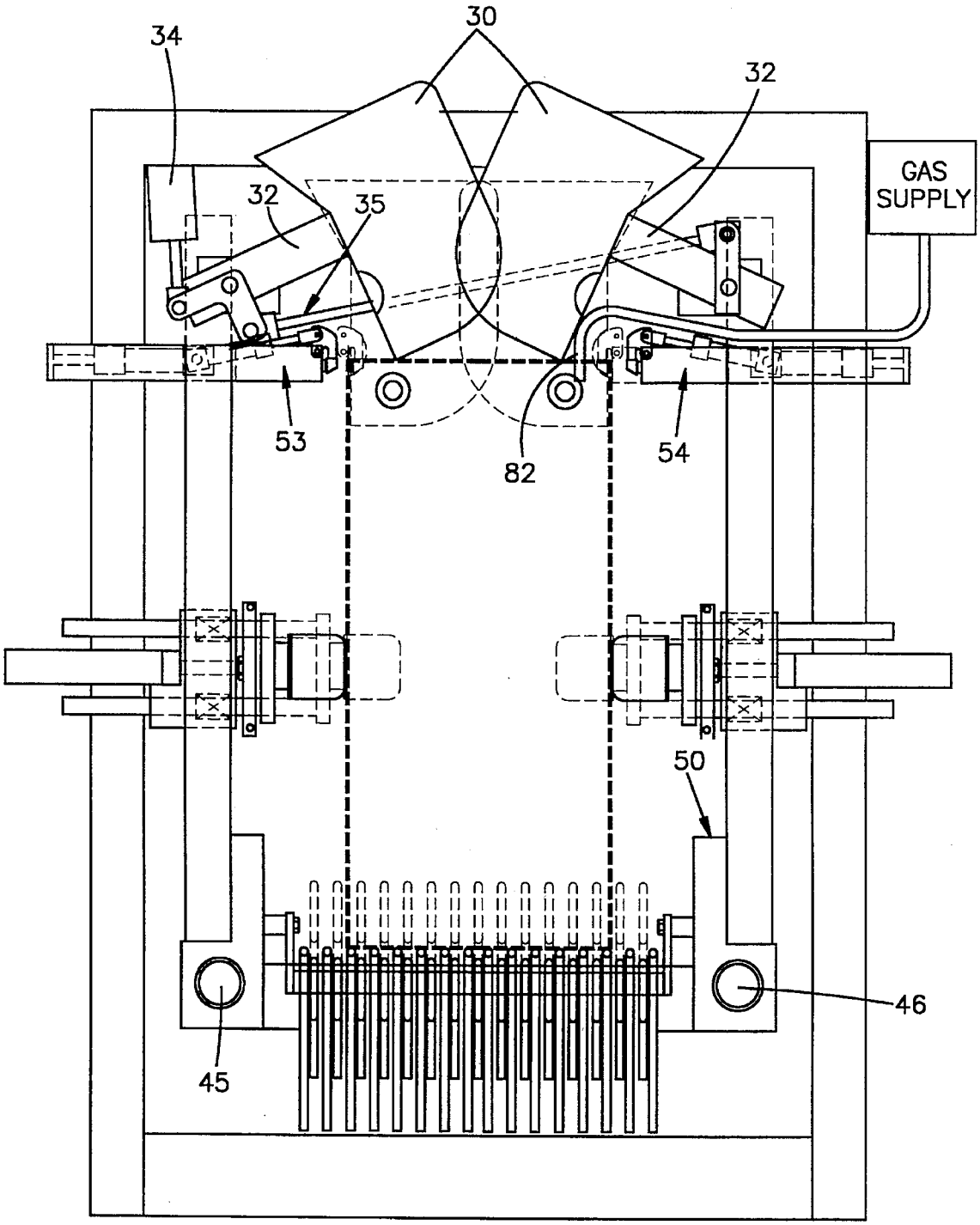
FIG. 2 is a front elevational view of the machine of The Issued Patents.

Referring now to FIGS. 1 and 2, the machine of The Issued Patents is shown. That machine includes a bagging machine made in substantial conformance with teachings of the Chicken Bagger Patent is shown schematically at 20. A bag supply of the type described and claimed in U.S. Pat. No. 4,201,029 entitled METHOD AND APPARATUS FOR PACKAGING is provided.

A chain of interconnected pre-opened bags is fed from the supply 21 along a path indicated schematically at 22 to feed rolls 23. Bags are fed downwardly sequentially, and one at a time from the feed rolls 23 to a load station 24.

An indicia detector is shown schematically at 25. The indicia detector is of the type described in U.S. Pat. No. 4,392,056 entitled CONTROL MARKING DETECTOR. The bags are equipped with invisible indicia of the type described in U.S. Pat. Nos. 4,467,207 entitled NON-MIGRATING CONTROL INDICIA FOR A PLASTIC WEB OR SHEET ARTICLE and 4,680,205 entitled CONTINUOUS WEB REGISTRATION. The indicia and detector function to send a signal to a control 26. The control in response to the receipt of a signal indicating a bag is appropriately positioned at the load station stops the operation of the feed rolls 23.

A blower 27 is provided. The blower selectively supplies a supply of air through a tube 28. Air supplied through the tube 28 blows a bag positioned at the load station 24 open as a first step in the loading operation.

A pair of horns 30 is provided, FIG. 2. The horns are respectively carried by pivotal arms 32. A horn actuating cylinder 34 is connected to the arms 32 by a linkage shown at 35. The horns are movable from a retracted position shown in solid lines in FIG. 2 to a bag expansion position indicated in phantom in FIG. 2. The movement of the horns from the retracted to the bag expansion position is accomplished after a bag to be loaded has been positioned in the load station and inflated by air supplied through the air tube 28. Once in the bag expansion position the horn expands the top of the bag to the position best seen in FIG. 7.

A material supply hopper 36 is positioned above the load station 24. The hopper includes a swingable gate 37 for selectively discharging products to be packaged.

The Bag Transfer Mechanism

A bag transfer mechanism is shown generally at 38. Since the bag transfer mechanism of FIGS. 1 and 2 is that of The Issued Patents and the improvements of this disclosure are primarily embodied in the transfer mechanism, reference is made to The Issued Patents for a detailed description of the transfer mechanism of FIGS. 1 and 2.

A carriage 50 is reciprocally mounted on the guide rods 45, 46. Linear bushings 51, 52 journal the carriage on the guide rods for reciprocal motion between a bag loading position and a bag transfer position.

A pair of bag spreader assemblies 53, 54 are provided, see FIG. 2. The spreader assemblies are mirror images of one another. Their construction, operation, and function are best understood by reference to FIGS. 3A–C of The Issued Patents.

Once a bag has been loaded, horns are pivoted to the position shown in solid lines in FIG. 2. Equal and opposite movement of the bag spreaders 62, 63 with the bags gripped by the fingers, tensions the bag pulling top portions of the front and back of the now loaded bag into juxtaposition. This tensioning both closes the bag and expels entrapped air. At the time when the bag is tensioned with the machine of The Issued Patents, the bag may be evacuated or purged with an inert gas via a tube 82 extended into the bag as indicated in FIG. 2. The carriage 50 is then shifted to the right, as viewed in FIG. 1, to position the load bag in a closure station at 56.

The Bag Compaction and Transfer Mechanism

Figure 3:
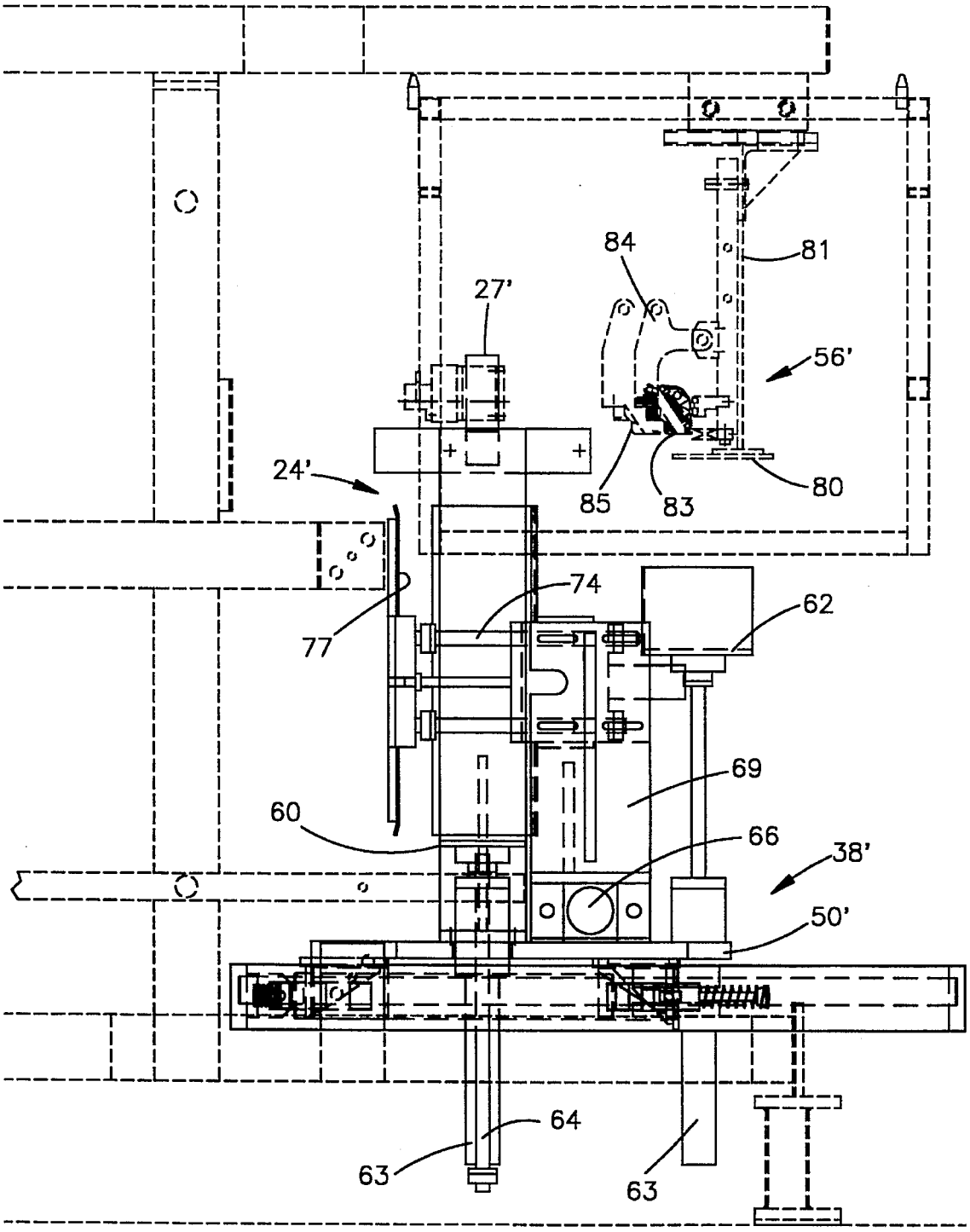
FIG. 3 is a side elevational view of the machine embodying the improved transfer mechanism.
Figure 4:
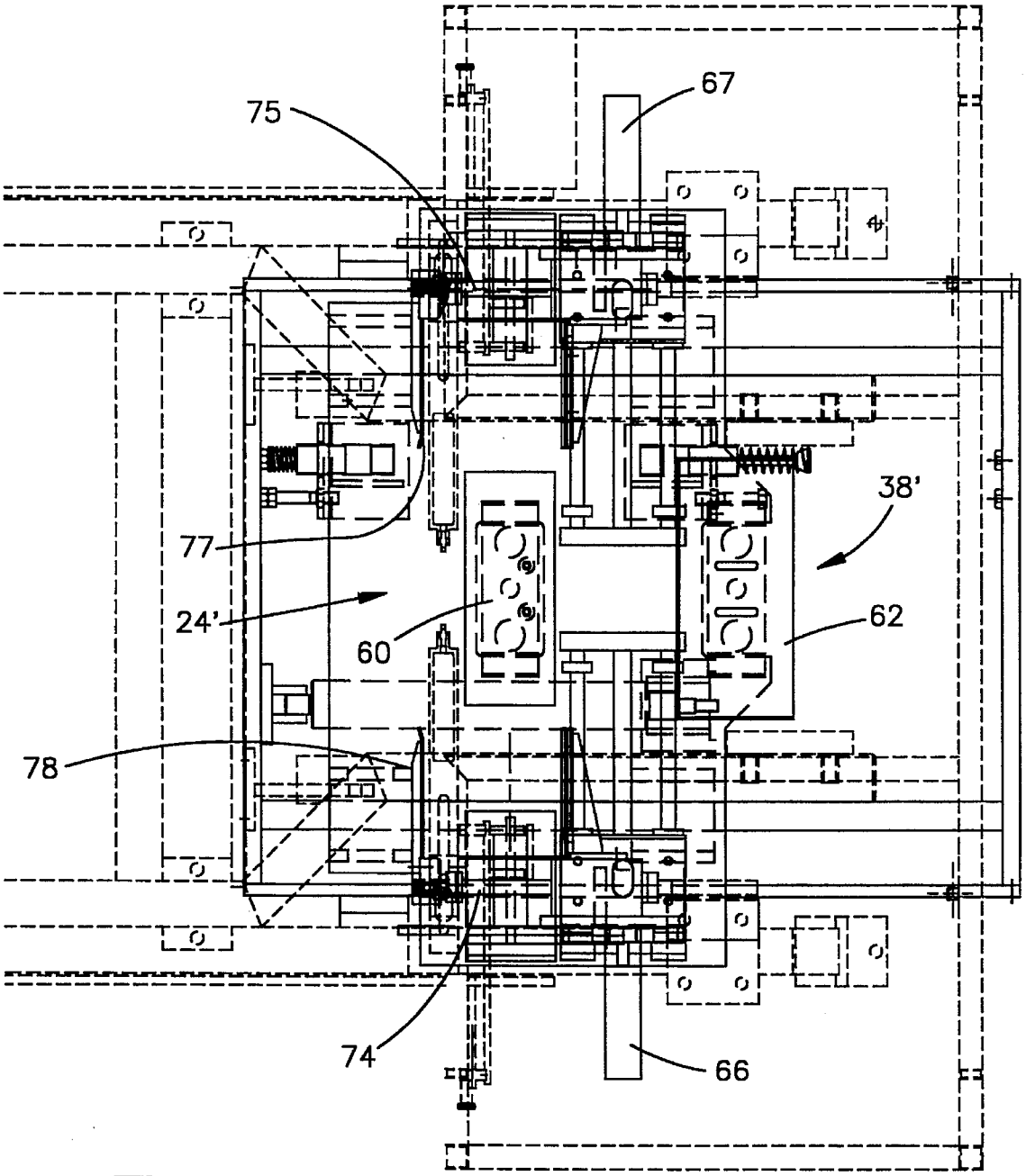
FIG. 4 is a top plan view of the machine of FIG. 3.
Figure 5:
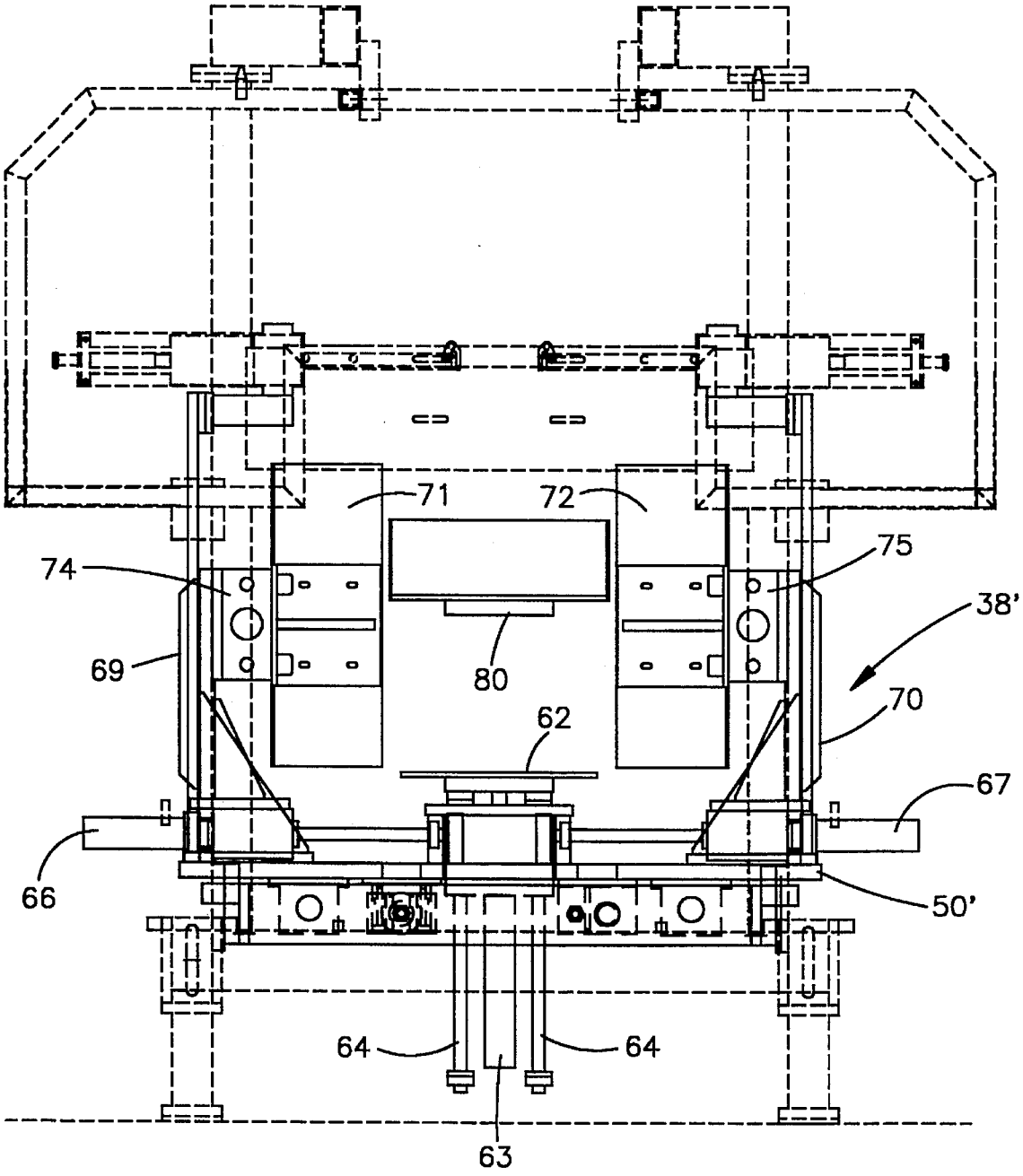
FIG. 5 is a front elevational view of the machine of FIGS. 3 and 4; and, FIGS. 6 and 7 are respectively top and side elevational views of a horn construction suitable for use with the transfer mechanism and process of this invention.

Referring to FIGS. 3–5, an improved bag compaction and transfer mechanism is shown at 38'. An elevatable base 60 is provided. The elevatable base 60 is carried by the transfer mechanism 38'. The elevatable base 60 delineates the bottom of load station 24' when the transfer mechanism is in the position shown in FIGS. 3 and 4.

An elevatable closed bag support 62 is also mounted on the transfer mechanism 38'. The closed bag support 62 is to the right of the base 60 as viewed in FIGS. 3 and 4. When the transfer mechanism 38' is positioned with the base at the closure station, the closed bag support is beneath the bag closure 56' to support a completed package prior to its ejection from the machine.

Both the base and the closed bag support are vertically reciprocal. Identical air cylinders 63 are coupled to the base and the support 60, 62, respectively to effect such vertical reciprocation. Guide rods 64 extend through linear ball bushings, not shown, to maintain appropriate orientation of the base support 60, 62 as they respectively vertically move. The cylinders and guide rods 63, 64 are preferably provided by a commercially available unit sold under the trademark BIMBA, Model CT-00103-A, known as "Linear Thrusters."

A horizontally disposed and opposed pair of linear thrusters 66, 67 are provided, see FIG. 5. The horizontal thrusters 66, 67 are mounted on the carriage 50' and form a part of the transfer mechanism 38'. The horizontal thrusters 66, 67 are preferably BIMBA Model CT-00101-A.

Bag shaper support brackets 69, 70 are respectively mounted on the horizontal thrusters 66, 67. A pair of the opposed vertically elongated, L-shaped bag shaping sections 71, 72 are respectively carried by the support brackets 69, 70. The brackets 69, 70 also respectively carry a pair of linear thrusters 74, 75. The thrusters 74, 75 are horizontally disposed and orthogonal with respect to the thrusters 66, 67. Thus, the thrusters 66, 67 effect transverse movement relative to the carriage 50 while the thrusters 74, 75 effect longitudinal movement relative to the brackets 69, 70.

The thrusters 74, 75 respectively carry back plates 77, 78. Thus, the thrusters 74, 75 are respectively back plate thrusters which function to shift the back plates 77, 78 relative to the bag shaping sections 71, 72, respectively. The back plates and L-shaped sections together delineate a channel of the square U horizontal cross section which function to shape a bag being loaded.

A squasher plate 80 is provided. The squasher plate 80 is mounted at the base of a bag sealer support bracket 81, see FIG. 3. The bag sealer support bracket is omitted from FIGS. 4 and 5 for clarity of illustration.

Thus, the transfer mechanism includes a compactor for use in compacting a product during a packaging operation. With this compactor, the transfer mechanism delineates a compactor frame structure which carries a base that is vertically spaced from the squasher plate when the mechanism is at the load station to delineate the top and bottom of a compaction space. The bag-shaping sections and the backplates are mechanisms which delineate the perimeter of the space. The cylinders and thrusters are a mechanism-producing means which selectively moves the mechanisms toward one another from spaced relative positions to product compaction positions delineating a product volume of a predetermined, reduced size and configuration.

Horns for Large Bags

For bulky products it is desirable to provide horns which distend a bag opening of a generally circular configuration as contrasted with a more conventional shape. For this purpose collapsible horn assemblies are desired.

Figure 6:
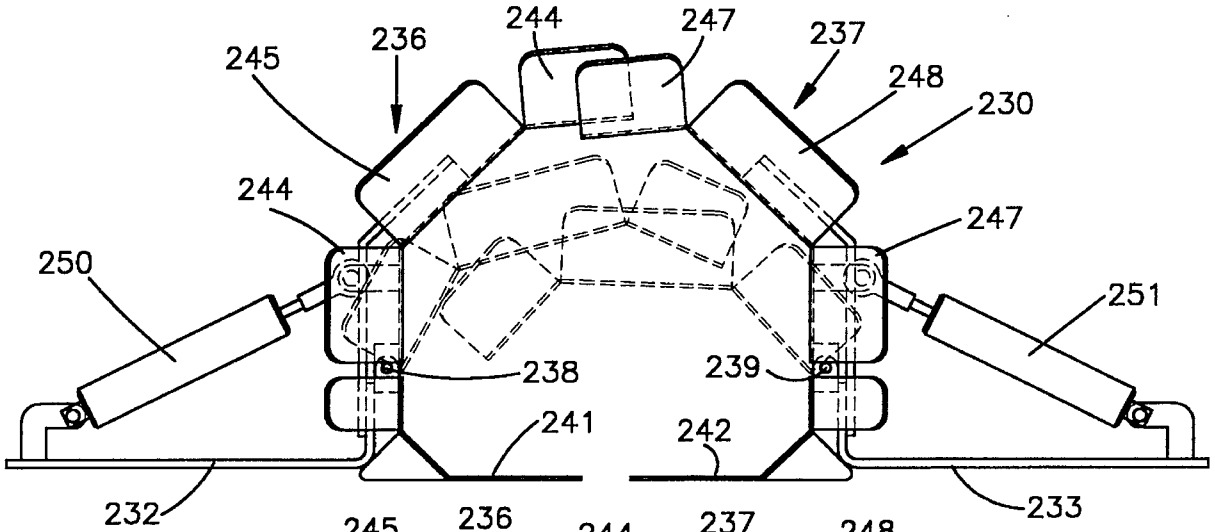
Figure 7:
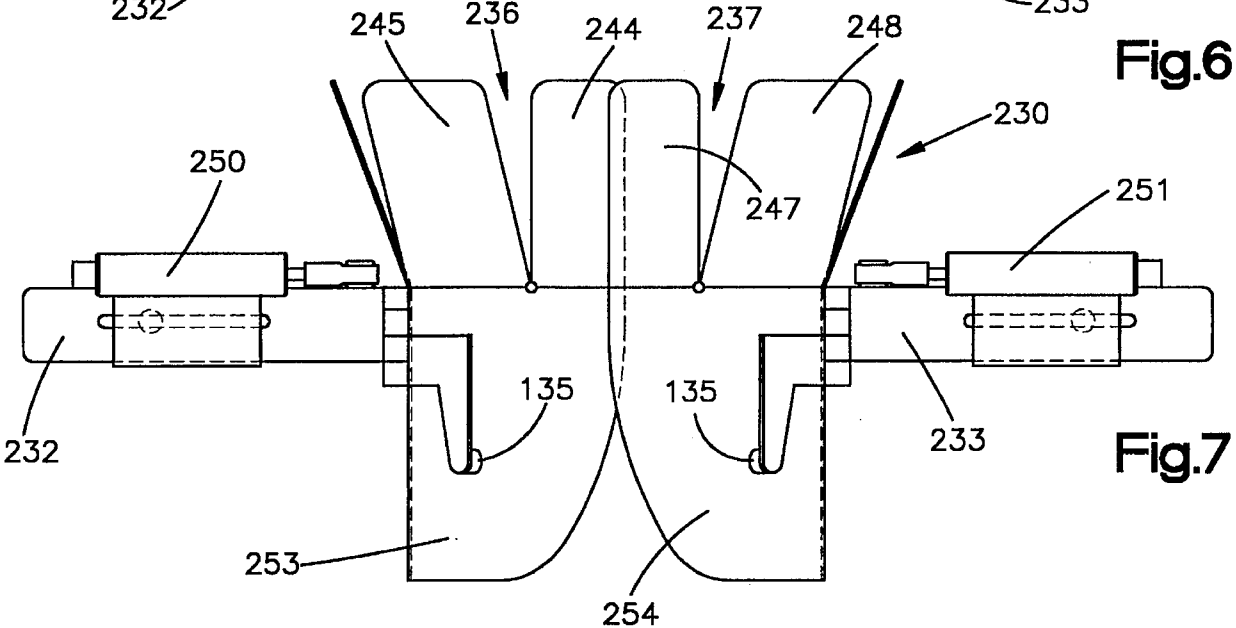

Referring now to FIGS. 6 and 7, one suitable collapsible horn assembly is shown generally at 230. The horn assembly 230 is used in lieu of either the horns 30 of FIG. 2 and other figures or the funnel horns of FIGS. 14 and 15 of U.S. Pat. No. 5,070,674, one of The Issued Patents. The horn assembly 230 is connected to the frame of the bag machine 20 by opposed mounting arms 232, 233.

A pair of mirror image pivotal horn sections are provided at 236, 237. The pivotal sections 236, 237 are pivotally connected at 238, 239 respectively to mirror image fixed horn sections 241, 242. The horn section 236 has end parts 244 connected by a central part 245. The other horn section 237 in turn has end parts 247 connected by a central part 248.

A cylinder 250 is interposed between and pivotally connected to the mounting arm 232 and the pivotal horn section 236. A corresponding cylinder 251 is interposed between and connected to the mounting arm 233 and the pivotal horn 237.

When a bag is fed to a load station, pivotal horn sections 236, 237 are in positions shown in phantom lines in FIG. 6. Once the bag is positioned and inflated the horn assembly 230 and the inflated bag are moved relatively so that bag engagement skirts 253, 254 respectively of the horn sections 236, 237 extend into the inflated bag. The cylinders 250, 251 are then actuated to move the arm sections 236, 237 from their phantom to their solid line positions of FIG. 6 such that the bag is engaged and extended by the skirts 253,254 acting to pull the positioned bag against skirts of the fixed sections 241,242. At this juncture bag clamps 135 are brought into engagement with the bag. At least one of these clamps 135 preferably corresponds to the bag clamp and sensor 135 shown in FIGS. 9A–C of the Issued Patents and described in more detail in conjunction with those figures. The bag clamp 135 is equipped like the clamp and sensor 135 of the issued patents to emit a signal to prevent machine cycling unless a bag is appropriately positioned in the load station for loading.

When the horn assembly of FIG. 6 is in its solid line position, the opening of a positioned bag is, as has been described, generally circular, but more precisely might be considered to be generally "u" shaped with the opening of the "u" closed by the fixed sections 241,242. As is plainly seen in FIGS. 6 and 7, each of the parts 244,245,247 and 248 of the moveable sections has a guide portion flaring upwardly and outwardly from its skirt. Each of these guide portions functions as a segment of a funnel, so that collectively the guide portions function as a funnel to deflect gravity fed products into and through the opening of a positioned bag and into the bag.

Seal Assembly

The sealer at the closure station 56' is similar to the clamp and seal mechanism disclosed in the parent case, but has important differences. An enlarged sealer pad 83 is provided. A seal linkage 84 is provided. The seal linkage 84 carries a sealer 85. The linkage is movable selectively to clamp the top of a bag between the sealer 85 and the pad 83 and to release a bag once sealed.

The sealer 85 is unique in that it has three parallel sealer bars. The upper of the sealer bars is controlled individually and separately from the two lower sealer bars which are controlled together. The upper bar is maintained at an elevated temperature to both effect a seal and a cut-off of excess plastic above the seal. The lower two bars are maintained at a cooler temperature to effect high-quality parallel seals. Two such seals are provided as a redundancy to assure effective and complete sealing of the bag.

Operation

A bag supply 21 is provided and the bags are fed from the supply 21 along the path 22 to the feed rolls 23. On an appropriate start signal from the controller 26 the feed rolls are operated to feed the end one of the chain of bags into the load station 24. As soon as the detector 25 senses the indicia on the bag being positioned feed stops.

As feed is stopped, the positioned bag is blown open and the horn assembly 230 is moved from the phantom line position of FIG. 6 to the solid line position to expand and grip the bag.

If no bag is present, or if it is improperly positioned, sensor 135 will detect the problem and complete a circuit. A signal is then sent to the control 26 which will disable all operations other than causing the feed rolls to attempt to feed another bag. The machine will make two attempts in addition to the original faulty attempt and if no bag is properly positioned after the three attempts, the control will then shut the machine down.

Once the bag is appropriately positioned in the load station, the horizontally opposed thrusters 66, 67 are actuated to move the bag support assemblies from the spaced position shown in FIGS. 4 and 5 to a position in which the bag shaping sections 71, 72 are juxtaposed. The product is then inserted into the bag such as, for example, a quantity of leaf lettuce. The back plate thruster 74, 75 are then energized to move the back plates 77, 78 forwardly to a desired position to provide a generally rectangular perimetral support for the now loaded bag. If desired, the back plate thrusters 74, 75 may be oscillated so that the back plates 77, 78 agitate the bag contents to cause them to settle in the bag into a smaller volume and concurrently expel air. Alternately, and preferably with the leaf lettuce example, the base 60 is oscillated by its connected cylinder 63 to shake the bag contents causing them to settle and expel air.

Next, the carriage 50' is shifted to the right as seen in FIG. 3. As the carriage is shifted, a limit switch, not shown, causes the base to be elevated. Concurrently, the closed bag support is lowered. As the carriage continues its movement and the base plate continues its elevation, the loaded bag is forced under the squasher plate 80 to further compress the now perimetrally confined bag contents and expel air.

Thus, as the elevated and filled bag passes under the squasher plate 80, the plate engages a side of the bag which is the right and leading side as viewed in FIG. 3. The leading side of the bag slides under the plate completing the surrounding, perimetrical, confinement of the bag and compression of its contents. Since the top of the bag is spread and retained by the spreader assemblies 53, 54, a top portion of the bag projects outwardly from the perimetrical confinement and is readily engageable by the sealer and pad 85, 83.

The sealer is now actuated to clamp and seal the loaded bag. Once the loaded bag has been engaged by the sealer and clamp mechanism, the horizontal thrusters 66, 67 and 74, 75 are actuated to return the shaping sections 71, 72 to the spaced position shown in FIG. 5, and the back plates 77, 78 to the spaced position shown in FIG. 3. After the sealer has commenced its clamping and sealing operation and the shaping sections are spaced, the carriage returns to the left, as viewed in FIG. 3, as the base 60 is lowered for the next cycle and the closed bag support 62 is raised to support the bag being sealed. As will be seen in FIG. 3, when the transfer mechanism has completed its cycle, the closed bag support is under the closure station 56'. When the seal has been completed, the sealer released the bag to drop it onto the closed bag support. On the next cycle, the loaded bag will be expelled from the machine.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A horn assembly for assisting in the loading of bulky products into bags sequentially positioned in a loading station comprising:

a) a mirror image pair of fixed horn sections adapted to be connected to a bagging machine adjacent a loading station;

b) a mirror image pair of moveable horn sections respectively pivotally connected to the fixed sections;

c) the moveable sections having a collapsed partially overlapping position for facile insertion into and removable from a bag positioned in such loading station;

d) the moveable sections having a bag distending position for extending a top opening of such positioned bag;

e) the moveable sections each having a generally curved configuration such that when in the distending position bag engaging surfaces of the moveable sections define a generally "U" shaped configuration; and, f) a pair of prime movers interposed between the stationary and moveable sections respectively to shift the moveable sections from one position to the other and return.

2. The assembly of claim 1 wherein the moveable sections comprise a plurality of parts each having a bag engaging portion and an outwardly flaring portion whereby the parts collectively function like a portion of a funnel.

3. A horn arrangement for use in a bagging machine for supporting a bag and extending it into an open condition for loading comprising:

a) a fixed horn section connected to a bagging machine and including an upwardly oriented product guiding portion and a lower bag engaging skirt;

b) a pair of movable horn sections movably connected to the fixed horn section and each including an upwardly oriented product guiding portion and a lower bag engaging skirt, the movable sections being oppositely oriented mirror images of one another;

c) the movable sections having bag release and insertion positions and engagement and loading positions; and, d) a pair of prime movers respectively interposed between and connected to the sections for moving the movable sections from the bag release to the bag engagement positions and return.

4. The horn arrangement of claim 3 wherein the movable sections are oppositely oriented mirror images of one another.

5. A horn assembly for use with a bagging machine comprising:

a) a pair of mirror image horn assemblies;

b) each assembly comprising:

i) a fixed section;

ii) a movable section movably connected to the fixed section; and, iii) a prime mover interposed between the sections for moving the sections between collapsed and extended positions;

c) the sections being readily insertable into a bag opening when in the collapsed position and being adapted to engage bag surfaces deforming a bag opening to distend the bag for loading when in the extended position; and, d) each of the horn sections including at least one bag engaging skin portion and a connected outwardly flaring portion.

6. The horn assembly of claim 5 wherein each of the movable sections includes a plurality of bag engaging portions.

7. The horn of claim 5 wherein each of the movable sections includes a plurality of skirt portions angularly oriented with respect to one another whereby the skirt portions of all of the sections collectively cause a bag to define a generally circular opening when engaged by the skirt portions and the sections are in their extended positions.

8. The horn of claim 5 wherein each of the movable sections includes three parts and each of the parts includes a skirt portion.

9. The horn of claim 5 wherein the movable sections partially overlie one another when in the collapsed position.

* * * * *